United States Patent [19]

Kötting

[11] Patent Number: 4,841,677

[45] Date of Patent: Jun. 27, 1989

[54] DEVICE FOR DISENGAGING A SUCTION MECHANISM FROM A LENS

[75] Inventor: Fritz Kötting, Dormagen, Fed. Rep. of Germany

[73] Assignee: Wernicke & Co. GmbH, Düsseldorf, Fed. Rep. of Germany

[21] Appl. No.: 191,231

[22] Filed: May 6, 1988

[30] Foreign Application Priority Data

May 11, 1987 [DE] Fed. Rep. of Germany ..... 3715619

[51] Int. Cl.[4] ..... B25B 11/00; B24B 13/005

[52] U.S. Cl. ..... 51/216 LP; 51/235; 269/21; 279/3; 248/205.8; 294/64.1

[58] Field of Search ..... 51/216 LP, 216 T, 217 R, 51/217 T, 235; 248/205.8, 206.2, 362, 363; 269/21; 279/3; 294/64.1

[56] References Cited

U.S. PATENT DOCUMENTS 2,212,755 8/1940 Solomon ..... 294/64.1
2,311,525 2/1943 Ebbs ..... 269/21
2,441,472 5/1948 D'Avaucourt ..... 51/216 LP
3,321,870 5/1967 Bolden ..... 51/235

FOREIGN PATENT DOCUMENTS 912441 12/1962 United Kingdom ..... 51/235
23334 of 9191 United Kingdom ..... 51/235

*Primary Examiner*—Robert P. Olszewski
*Attorney, Agent, or Firm*—Becker & Becker, Inc.

[57] ABSTRACT

A device for disengaging a suction mechanism from a lens. A housing is provided that has an upper supporting rim for a lens. The device also has a gripping member that is adapted to grasp the base of the suction mechanism in a forceps-like manner. The gripping member is accommodated in the housing in such a way as to be axially movable therein. When the gripping member moves out of a starting position and away from the supporting rim, the lens is drawn against the latter and can be diengaged from the suction mechanism.

16 Claims, 3 Drawing Sheets

DEVICE FOR DISENGAGING A SUCTION MECHANISM FROM A LENS

BACKGROUND OF THE INVENTION

The present invention relates to a device for releasing or disengaging a suction mechanism from a lens, such as a spectacle lens.

To hold lenses in position so that their edges can be ground, these lenses are held between two coaxial, rotating shaft halves. One of the two shaft ends is provided with an engaging piece, on or relative to which is mounted the base of a suction mechanism, with the aid of which one side of the lens is held so that the lens can be rotated via the shaft half. When the suction mechanism is placed upon the lens, a vacuum is generated within the suction mechanism so that the lens can withstand the radial grinding pressure. The release or disengagement of the suction mechanism that adheres or clings to the lens, i.e., the elimination of the vacuum of the suction mechanism, is cumbersome, time consuming, and is frequently carried out in an incompetent manner, resulting in damage to the suction mechanism and/or to the lens.

It is therefore an object of the present invention to provide a device of the aforementioned general type that is structurally straightforward and can be operated without difficulty, whereby the suction mechanism and above all that surface of the lens upon which the suction mechanism is placed, remain undamaged. In addition, the device should require little space, and should eliminate the danger of injury or harm.

BRIEF DESCRIPTION OF THE DRAWINGS

These and other objects and advantages of the present invention will appear more clearly from the following specification in conjunction with the accompanying schematic drawings, in which.

SUMMARY OF THE INVENTION

Figure 1:
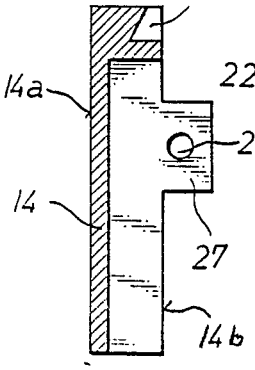
FIGS. 1–8 are views that illustrate individual components of one exemplary embodiment of the inventive device.
Figure 2:
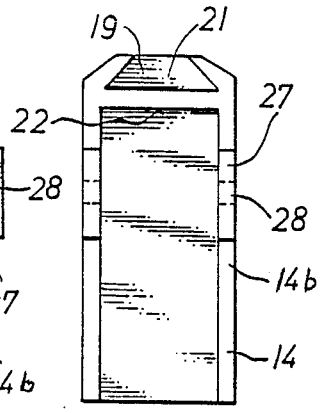

The inventive device is characterized primarily by a housing that has an upper supporting rim for a lens, and by a gripping member that is adapted to grasp the base of the suction mechanism in a forceps-like manner, with the gripping member being accommodated in the housing in such a way as to be axially movable therein, whereby when the gripping member moves out of a starting position and away from the supporting rim, the lens is drawn against the latter and can be disengaged from the suction mechanism.

With the inventive device, after a forceps-like displacement of the two half shells, a slight deformation of the resilient base of the suction mechanism, is effected, such base preferably being made of rubber. As a result of this deformation, a comparative interlocking of the base of the suction mechanism is achieved via a vertical pulling component of the device, thereby effecting the ultimate disengagement of the suction mechanism from the lens. This disengagement begins when the surface of the lens rests upon the rim of the housing, and is concluded during the further axial downward movement of the half shells that securely hold the base of the suction mechanism. All this occurs without the lens surface suffering damage or the suction mechanism becoming unusable.

Further specific features of the present invention will be described in detail subsequently.

DESCRIPTION OF PREFERRED EMBODIMENTS

Referring now to the drawings in detail, the inventive device has a ring-like base 1 that is provided at the side with a support arm or bracket 2 that imparts the necessary stability to the device during its operation. The ring 1 has a central hole 3 with an inner surface 4. The ring-like base part 1 is connected via screws 5 with the wider lower portion 6 of a bushing or sleeve 7 that is surrounded by a cylindrical housing 8. The upper portion 8*a* of the housing extends over the upper end of the sleeve 7, and the lower portion of the housing 8 is provided with a slot 38.

The upper rim of the housing 8 can be provided with a flexible ring 9 upon which the outer surface O of the lens B rests, as will be described subsequently.

Figure 3:
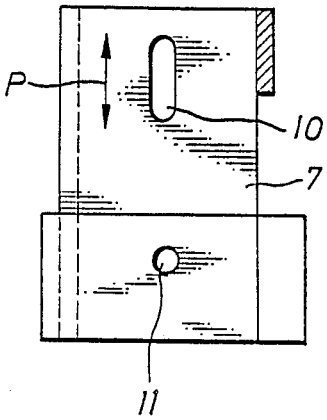
Figure 4:
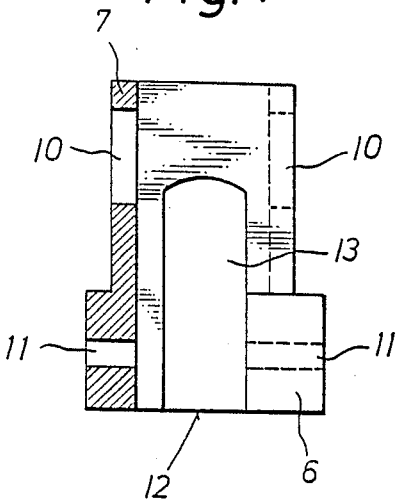

The sleeve 7, different views of which are illustrated in FIGS. 3 and 4, is provided with two vertical, coaxial slots 10, as well as two coaxial transverse bores 11 that are disposed in the lower part of the sleeve 7 below the slots 10. Finally, one side of the sleeve 7 is provided with a wide elongated slot 13 that begins approximately at the level of the middle of the slots 10 and extends to the bottom 12 of the sleeve.

The sleeve 7 accommodates the two half shells 14, 15, with the periphery 14*a* of the half shell 14, as well as the periphery 15*a* of the other half shell 15, both forming an incomplete semicircle. As can be seen from FIG. 9, in their starting position the two half shells 14, 15 allow a clearance Z of a magnitude of "a" to be formed, with the magnitude of this clearance being reduced upon actuation of the movable parts of the device, as will be described subsequently. In this starting position, the two faces 14*b* and 15*b* of the half shells 14, 15 are spaced from one another by the magnitude "a" and together form a cylinder, with the outer peripheries 14*a*, 15*a* resting against the inner wall 16 of the upper portion 8*a* of the housing 8.

The two half shells 14, 15 form a forceps-like gripping member for the base 17 of the resiliently deformable suction mechanism S, which sticks or adheres to the surface O of the lens B. The base 17 of the suction mechanism S has a cylindrical configuration and is provided with an annular circumferential surface 18. In their starting position, the two half shells 14, 15 are opened in such a way that the base 17 of the suction mechanism S can be inserted into the two upper recessed portions 19, 20 of the two half shells 14, 15. Each of these recessed portions 19, 20 has an inclined wall 21 and a horizontal bottom 22. As a result, between the peripheral surface 18 of the base 17 and the inclined walls 21 of the two half shells 14, 15 there is formed a space 23 that widens toward the bottom and that has a triangular cross-sectional shape. When the two half shells 14, 15 are pressed together, accompanied by reduction of the clearance Z between the two faces 14*b*, 15*b* of the half shells, the base 17 of the suction mechanism S deforms conically in the space 23 (see FIG. 10), as a result of which a coupling and interlocking of the base 17 in the recessed portions 19, 20 of the half shells is achieved.

Figure 6:
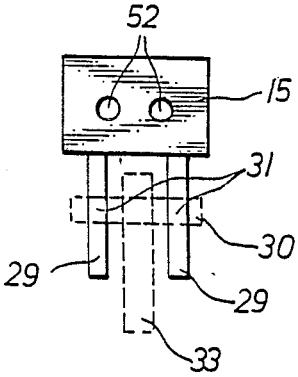
Figure 7:
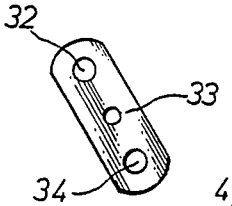

The half shell 14 is provided with two extensions 27 that proceed from the faces 14*b* of the half shell and have coaxial holes 28. the extensions 27 are curved and are disposed in the continuation of the curved surface of the half shell 14. The other half shell 15 is provided with two lower, tang-like extensions 29 that are offset inwardly relatively to the wall of the half shell 14, i.e. toward the central axis M of the device (see FIGS. 6 and 9). The extensions 29 of the half shell 15 are embodied in such a way that they can be embraced by the two extensions 27 of the half shell 14. In this way, it is possible to insert a pivot pin 30 through the holes 28 of the extensions 27 and through the holes 31 of the extensions 29. The ends of the pivot bolt 30 can slide and be guided upwardly and downwardly, in the direction of the arrow P, in the two slots 10 of the sleeve 7.

The pivot pin or bolt 30 also passes through the hole 32 of a link member 33 that is pivotably mounted on the pin 30 between the tang-like extensions 29 of the half shell 15; the link member 33 is also provided with a lower hole 34.

The movable parts of the inventive device are adjusted via a lever 36 that can be moved about a pin 37 in the direction of the arrow K (FIG. 9) in the elongated slot 13 of the sleeve 7 and in the slot 38 of the housing 8, with the slots 38 and 13 being aligned with one another. The lever 36 is provided with a prong-like end portion 39 that has holes 40 in both prong parts, with the pin 37 extending through these holes 40; the ends of the pin 37 are held in the coaxial bores 11 of the sleeve 7. The prong parts of the portion 39 of the actuating lever 36 are furthermore provided with coaxial holes 41 through which is inserted a further pivot pin 42, the length of which corresponds to the width of the portion 39, in which the pin 42 ends. The link member 33 extends between the two prong parts of the lever 36 and is pivotably connected by the pin 42 to the lever 36 in the manner of a knee lever joint.

Figure 9:
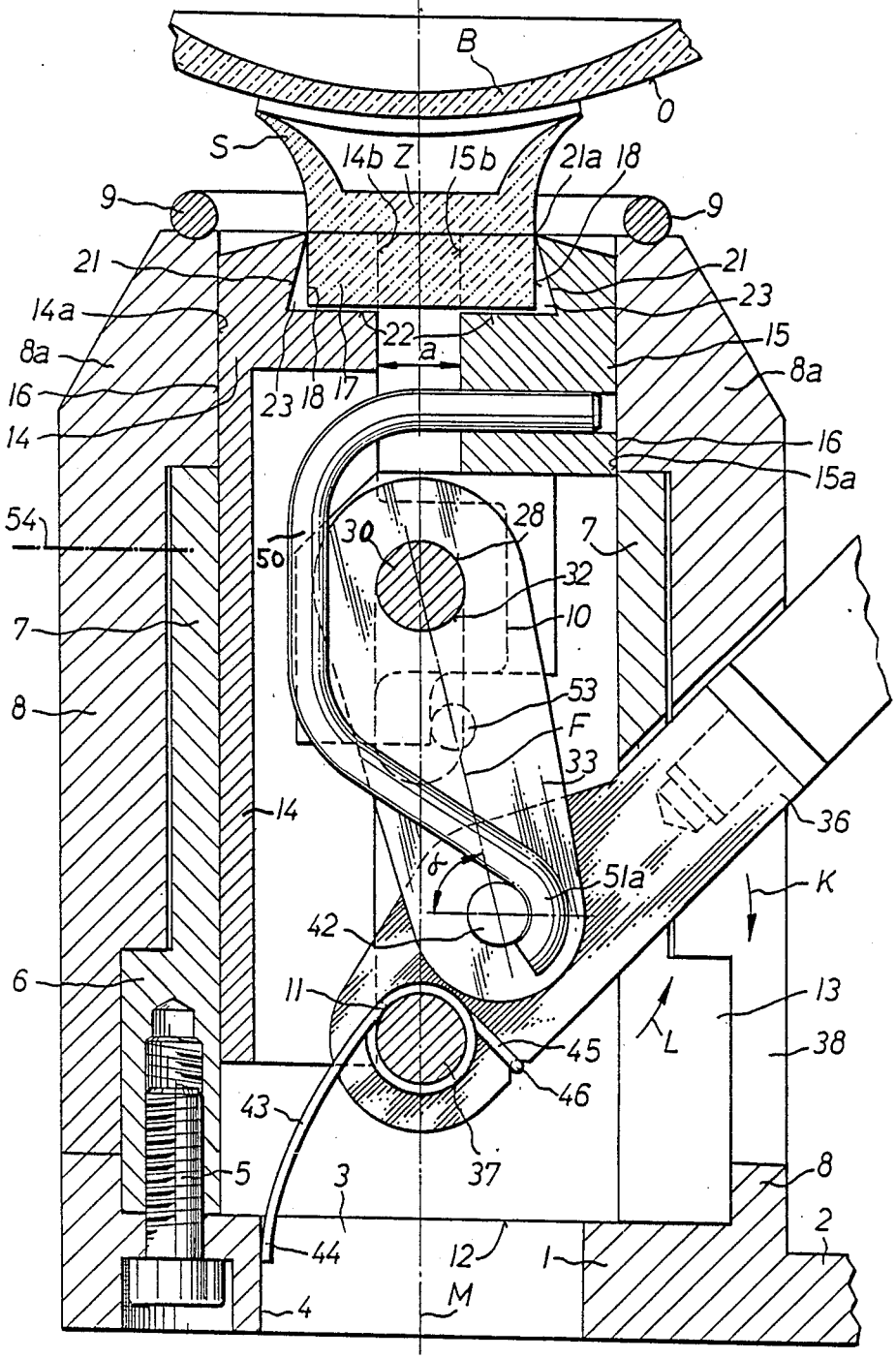
FIG. 9 is a vertical, cross-sectional view through the overall device in the starting position of the components, whereby the base of the suction mechanism is freely disposed between the forceps-like half shells of the device.

In order to hold the actuating lever 36 in the starting position that is illustrated in FIG. 9, a spring 43 is looped around the pin 37 between the two prong parts of the end portion 39. One end 44 of the spring 43 rests against the inner wall 4 of the hole 3 of the ring-like base or bracket 2, while the other end 45 of the spring 43 rests in a transverse recess 46 of the end portion 39 of the lever 36. As a result, a force is exerted upon the actuating lever 36 in the direction of the arrow L, and the two half shells 14, 15 are pressed upwardly via the link member 33 into the position illustrated in FIG. 9, so that the base 17 of the suction mechanism S is introduced into or removed from the recessed portions 19, 20 of the two half shells 14, 15.

If the actuating lever 36 is pivoted in the direction of the arrow K about the pin 37, the ends of which are mounted in the bores 11 of the stationary sleeve 7, the end portion 39 of the lever 36 pulls the link member 33 downwardly into a position that is more inclined than is the starting position. In so doing, the center line F of the link member 33 now forms an angle $\beta$ with the horizontal (see FIG. 10). This angle $\beta$ is less than the angle $\alpha$ that the center line F forms with the horizontal in the starting position of the components as illustrated in FIG. 9. Since the link member 33 is securely connected with the second half shell 15, the latter pivots about the pin 30 into the inclined position 15' shown in FIG. 10. In so doing, the clearance Z is reduced and, as indicated, the base 17 of the suction mechanism S is deformed and tightly held. However, along with the movement of the link member 33 via actuation of the lever 36, the pivot pin 30 is also pulled downwardly out of the position shown in FIG. 9 into the position 30' shown in FIG. 10, with the ends of the pivot pin 30 being guided in the slot 10. As a result, a vertical downward movement of the two half shell members 14, 15 into their position 14', 15' occurs, with the two half shells securely encircling the base 17 of the suction mechanism S and deforming this base 17 in the space 23. During this downward movement of the two half shells 14, 15, the surface O of the lens B comes to rest against the ring 9 that is disposed on the upper rim of the housing 8. If the pivot lever 36 is pressed down still further, a pulling force is exerted in the direction of the arrow W (FIG. 10), as a result of which the already deformed suction mechanism S is pulled from the surface O of the lens B without either the suction mechanism itself or the surface O of the lens B suffering any damage. If the suction mechanism S is disengaged from the lens B in this manner, the lever 36 can be released and the spring 43 will take care of returning the movable parts of the device to the starting position.

Figure 5:
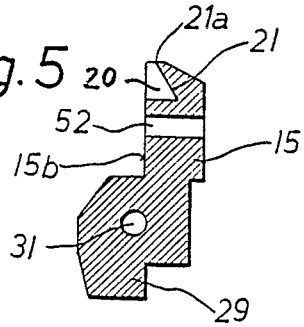
Figure 8:
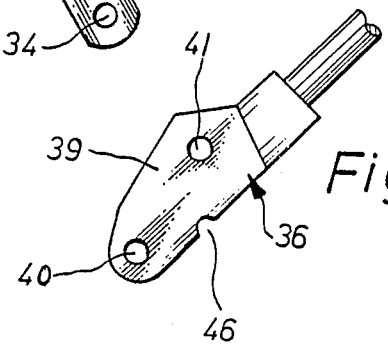

Since the inventive device can also be used for suction mechanism where the base is not deformable in the manner described in connection with the base 17 of the suction mechanism S, but rather is, for example, completely or predominantly made of metal, the pivotable half shell 15 is connected in a special way to the lever 36. This lever 36 must also be capable of being pivoted downwardly in the direction of the arrow K even when the half shell 15 approximately maintains its starting position, i.e. can be pivoted only to such an extent that the upper rim 21*a* of the inclined wall 21 of the recessed portion 20 (see FIGS. 5 and 9) rests snugly and securely against the nondeformable base of the suction mechanism. Thereafter, the lever 36 must be capable of being pivoted further in order to effect the downward movement of the two half shells 14, 15. For this purpose, the pivotable half shell 15 is connected to the link member 33 via a spring 50, the one end 51 of which extends into the two holes 52 of the half shell 15, while the other spring end 51*a* is disposed about the pivot pin 42 (FIG. 9). The spring 50, which preferably comprises two parallel pieces, is of such a strength that at first the aforementioned pressure of the half shell 15 against the rigid base of the suction mechanism results, prior to the downward movement of the half shells 14, 15 being initiated.

The walls 21 of the recessed portions 19, 20 of the half shells 14, 15 can also be provided with grooving or similar means, either alone or in conjunction with the described inclination, in order to reliably take along the base 17 of the suction mechanism S when the half shells 14, 15, and hence the base 17, are pulled downwardly.

Figure 10:
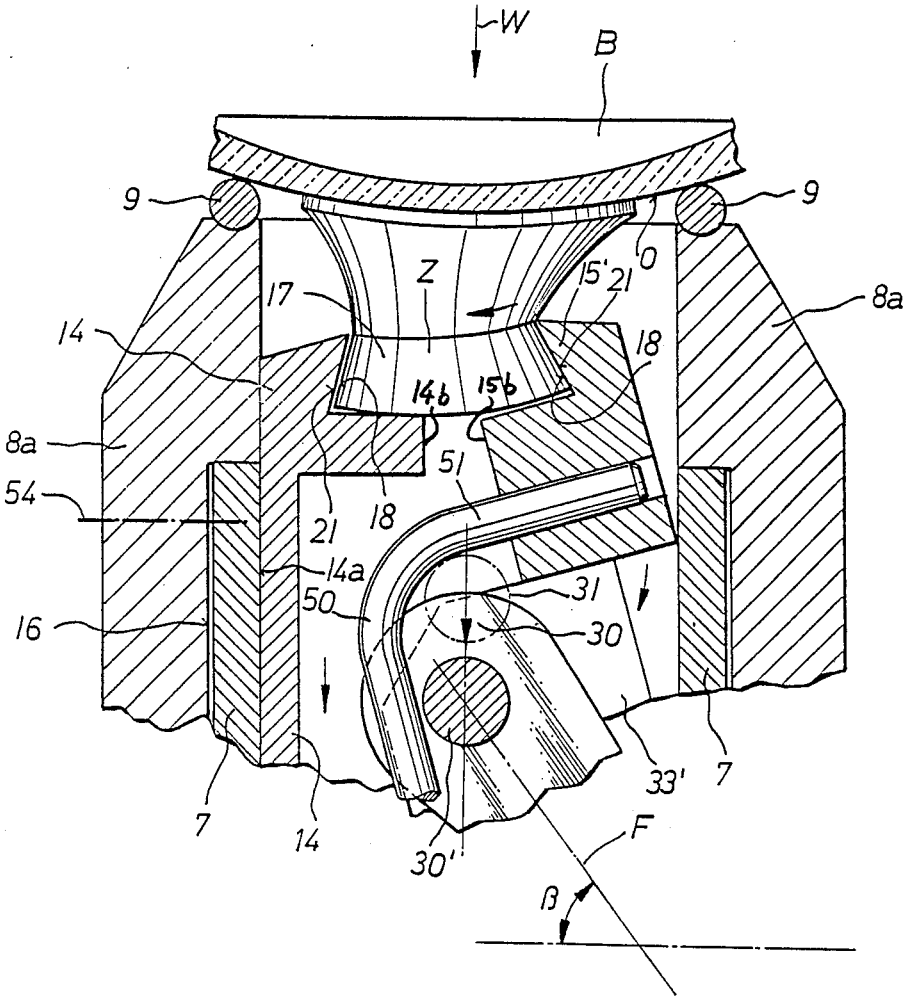
FIG. 10 is a view that shows the essential components of the device, with the lens surface resting against the rim of the housing, and the movable components being shown in the position after having moved downwardly out of the starting position.

The housing 8 and the sleeve 7 are interconnected via a screw connection 54 (see FIGS. 9 and 10).

The present invention is, of course, in no way restricted to the specific disclosure of the specification and drawings, but also encompasses any modifications within the scope of the appended claims.

What I claim is:

1. A device for disengaging a suction mechanism, which has a base, from a lens, said device comprising:

a housing having a supporting rim for said lens; and a gripping member that is adapted to grasp said base of said suction mechanism in a forceps-like manner, with said gripping member being formed from two half shells, each of which has a section that is disposed in the vicinity of said base of said suction mechanism and is provided with a face that is directed toward the face of the other half shell, with a clearance being provided between said faces that are directed toward one another; at least one of said half shells is pivotable relative to the other half shell to thereby alter the size of said clearance and effect said grasping of said base of said suction mechanism; said gripping member being accommodated in said housing in such a way as to be axially movable therein, whereby when said gripping member moves out of a starting position one of the two half shells is pivoted towards the other half shell thereby grasping the base of said suction mechanism and drawing said lens against said supporting rim and said suction mechanism can be disengaged from said lens.

2. A device according to claim 1, in which said aforementioned sections of said two half shells essentially together have the shape of a cylinder in said starting position of said device.

3. A device according to claim 2, which includes a sleeve that is securely and axially disposed within said housing; and in which said half shells of said gripping member are nonrotatably guided in said sleeve.

4. A device for disengaging a suction mechanism, which has a base, from a lens, said device comprising:

a housing having a supporting rim for said lens;

a gripping member that is adapted to grasp said base of said suction mechanism in a forceps-like manner, with said gripping member being accommodated in said housing in such a way as to be axially movable therein, whereby when said gripping member moves out of a starting position and away from said supporting rim of said housing, said lens is drawn against said supporting rim and said suction mechanism can be disengaged from said lens, said gripping member being formed from two half shells, each of which has a section that is disposed in the vicinity of said base of said suction mechanism and is provided with a face that is directed toward the face of the other half shell, with a clearance being provided between said faces that are directed toward one another, and with said aforementioned sections of said two half shells essentially together having the shape of a cylinder in said starting position of said device; at least one of said half shells is pivotable relative to the other half shell to thereby alter the size of said clearance and effect said grasping of said base of said suction mechanism; and a sleeve that is securely and axially disposed within said housing; said half shells of said gripping member being axially guided in said sleeve, said sleeve being provided with axially extending slots in which are guided ends of a first pivot pin, with said half shells having central portions that are interconnected via said first pivot pin in such a way as to provide for said pivotable relationship between said half shells.

5. A device according to claim 4, in which each of said aforementioned sections of said two half shells is provided with a recessed portion, which together essentially have the shape of an annular recess and surround said base of said suction mechanism.

6. A device according to claim 5, in which each of said recessed portions has an inclined surface, with the diameter of said annular recess increasing in a direction away from said supporting rim of said housing.

7. A device according to claim 4, in which one of said half shells is movable only axially in said sleeve and is provided with holes for said first pivot pin, with said other half shell being pivotable about said first pivot pin relative to said one half shell.

8. A device according to claim 7, which includes a link member through which said first pivot pin extends and which effects axial movement of said half shells in said sleeve.

9. A device according to claim 8, in which said link member has a first end that is directed in the direction of said suction mechanism, with said first pivot pin extending through said first end of said link member.

10. A device according to claim 9, which includes an actuating lever that has a central portion, and a first end that is pivotably connected to said sleeve remote from said suction mechanism; and in which said link member has a second end, remote from said first end thereof, with said second end of said link member being pivotably connected to said central portion of said actuating lever.

11. A device according to claim 10, which includes a second pivot pin that is connected to said sleeve and extends through said actuating lever to effect said pivotable connection of said first end of said lever to said sleeve.

12. A device according to claim 11, in which said pivotable one of said half shells is rigidly connected to said first end of said link member so as to pivot therewith.

13. A device according to claim 12, which includes a spring that is mounted in said housing and is connected to said actuating lever in such a way as to hold said lever, and hence the movable parts of said device, in a starting position.

14. A device according to claim 13, in which said housing and said sleeve, remote from said suction mechanism, are provided with slot means that are open to the outside and through which said actuating lever extends.

15. A device according to claim 14, in which said spring is looped around said second pivot pin of said actuating lever.

16. A device according to claim 15, which includes a further spring that interconnects said actuating lever and said pivotable one of said half shells.

* * * * *